US009828762B2

(12) United States Patent
Berg

(10) Patent No.: US 9,828,762 B2
(45) Date of Patent: Nov. 28, 2017

(54) EARTHQUAKE RESISTANT BUILDING CONNECTION AND AN EARTHQUAKE RESISTANT STAIRCASE SYSTEM

(71) Applicant: Svein Berg Holding AS, Åndalsnes (NO)

(72) Inventor: Svein Berg, Isfjorden (NO)

(73) Assignee: Svein Berg Holding AS, Åndalsnes (NO)

( * ) Notice: Subject to any disclaimer, the term of this patent is extended or adjusted under 35 U.S.C. 154(b) by 0 days.

(21) Appl. No.: 15/119,521

(22) PCT Filed: Feb. 27, 2015

(86) PCT No.: PCT/IB2015/051467
§ 371 (c)(1),
(2) Date: Aug. 17, 2016

(87) PCT Pub. No.: WO2015/132702
PCT Pub. Date: Sep. 11, 2015

(65) Prior Publication Data

US 2017/0009443 A1 Jan. 12, 2017

(30) Foreign Application Priority Data

Mar. 3, 2014 (NO) ..... 20140278

(51) Int. Cl.
*E04B 1/36* (2006.01)
*E04B 1/48* (2006.01)
(Continued)

(52) U.S. Cl.
CPC ..... *E04B 1/36* (2013.01); *E04B 1/483* (2013.01); *E04B 1/98* (2013.01); *E04F 11/022* (2013.01);
(Continued)

(58) Field of Classification Search
CPC ... E04B 1/36; E04B 1/483; E04B 1/48; E04B 1/68; E04B 1/82; E04B 1/38; E01C 11/14;
(Continued)

(56) References Cited

U.S. PATENT DOCUMENTS 5,005,331 A * 4/1991 Shaw ..... E01C 11/14 52/396.02
5,040,350 A * 8/1991 Panther ..... E01C 11/14 411/517
(Continued)

FOREIGN PATENT DOCUMENTS

DE 295 04 707 U1 5/1995
DE 44 09 477 A1 9/1995
(Continued)

OTHER PUBLICATIONS

International Search Report issued in PCT/IB2015/051467 dated May 28, 2015 (2 pages).
(Continued)

*Primary Examiner* — Andrew J Triggs
(74) *Attorney, Agent, or Firm* — Osha Liang LLP

(57) ABSTRACT

An earthquake-resistant building connection includes first and second structural elements lying a distance from each other, where the first element includes an outer side face that faces the second element. The first element includes at least one projecting member that projects from the outer side face of the first element into a cavity in the second element. The cavity is wider, higher and deeper than the member. The first element also includes an elastic component for absorbing forces and motions of an earthquake. The component has an outer surface that extends around the member and faces the second element, forming a fill area between the outer surface of the component and the second element and further between the member and the cavity. The fill area is filled
(Continued)

such that forces and motions transferred between the first and second elements in the event of an earthquake are absorbed in the component.

17 Claims, 5 Drawing Sheets

(51) Int. Cl.

| | |
|---|---|
| ***E04B 1/68*** | (2006.01) |
| ***E04B 1/98*** | (2006.01) |
| ***E04F 11/022*** | (2006.01) |
| ***E04H 9/02*** | (2006.01) |
| ***E06B 1/68*** | (2006.01) |
| *E04F 11/02* | (2006.01) |

(52) U.S. Cl.
CPC ..... *E04H 9/021* (2013.01); *E06B 1/68* (2013.01); *E04F 2011/0212* (2013.01)

(58) Field of Classification Search
CPC ..... E04H 9/021; E04H 9/02; E04F 11/022; E04F 2011/0212
See application file for complete search history.

(56) References Cited

U.S. PATENT DOCUMENTS

| | | | | |
|---|---|---|---|---|
| 5,216,862 | A * | 6/1993 | Shaw | E01C 11/14 52/396.02 |
| 5,674,028 | A * | 10/1997 | Norin | E01C 11/14 404/60 |
| 5,862,634 | A * | 1/1999 | Berger | E04B 1/483 52/127.1 |
| 7,520,101 | B2 * | 4/2009 | Berg | E04L 31/36 52/253 |
| 7,874,762 | B2 * | 1/2011 | Shaw | E01C 11/14 404/60 |
| 8,353,134 | B2 * | 1/2013 | Jiang | E04H 9/02 52/167.1 |
| 8,356,955 | B2 * | 1/2013 | Nadler | E01C 11/14 404/73 |
| 2005/0223659 | A1 * | 10/2005 | Berg | E04L 31/36 52/146 |
| 2010/0239366 | A1 * | 9/2010 | Bahr | F16B 13/141 403/268 |
| 2010/0313518 | A1 * | 12/2010 | Berg | E04L 31/215 52/707 |
| 2011/0085857 | A1 * | 4/2011 | Shaw | E01C 11/14 404/62 |
| 2011/0225908 | A1 * | 9/2011 | Nadler | E01C 11/14 52/223.6 |
| 2013/0298495 | A1 * | 11/2013 | Berg | E04L 31/215 52/708 |
| 2017/0009443 | A1 * | 1/2017 | Berg | E04F 11/022 |

FOREIGN PATENT DOCUMENTS

| | | | |
|---|---|---|---|
| DE | 195 02 711 | A1 | 10/1996 |
| DE | 19700765 | A1 | 7/1998 |
| DK | 0685613 | T3 | 2/1999 |
| EP | 0716192 | B1 | 5/1998 |
| JP | H08-284353 | A | 10/1996 |
| JP | H09-235908 | A | 9/1997 |
| JP | H11-148250 | A | 6/1999 |
| NO | 826748 | B1 | 2/2009 |

OTHER PUBLICATIONS

Written Opinion of the International Searching Authority issued in PCT/IB2015/051467 dated May 28, 2015 (5 pages).
Norwegian Search Report issued in NO 20140278 dated Sep. 23, 2014 (2 pages).

* cited by examiner

EARTHQUAKE RESISTANT BUILDING CONNECTION AND AN EARTHQUAKE RESISTANT STAIRCASE SYSTEM

One or more embodiments of the present invention relates to an earthquake-resistant building connection of two structural elements, i.e. a building connection capable of withstanding earthquake-induced oscillations and motions in the building, and to an earthquake-resistant staircase system in which such earthquake-resistant building connections are used.

During earthquakes there is a great danger of buildings being damaged or destroyed, thereby causing financial loss, injuries to people and, at worst, loss of human life. To prevent buildings from collapsing, a number of approaches have been proposed for connecting two structural elements such as, for instance a landing to a wall. JP11148250 proposes a solution an approach comprising a spring element such that a step can be moved horizontally relative to a landing, and where the step is in two parts such that the lower part slides into a cavity in which the spring element is arranged whilst the upper part slides over the outside.

Another document that relates to earthquake-proof buildings is JP 09235908, which shows a damping element that is arranged to absorb horizontal motions in the building.

Against this background, one or more embodiments of the present invention provide a connection of structural elements that has a simpler design than known methods for constructing earthquake-proof connections between structural elements in a building, and which is easy and quick to use during the construction of the building.

These one or more embodiments may be achieved by an earthquake-resistant building connection as defined in independent claim 1 and an earthquake-resistant staircase system as defined in claim 8. Further embodiments of the earthquake-resistant building connection may be defined in dependent claims 2-7, whilst further embodiments of the earthquake-resistant staircase system may be defined in dependent claims 9-15.

One or more embodiments of the present earthquake-resistant building connection between two structural elements comprises primarily a projecting element that projects from a first structural element and into a cavity in a second structural element without being in direct contact with this structural element. The first structural element is provided with an elastic element and the fill area between the elastic element and the second structural element, including the cavity, is filled with filler, as for instance mortar, such that in the event of an earthquake, forces and motions that are transferred between the first structural element and the second structural element will be capable of being absorbed in the elastic element.

Accordingly, there is provided an earthquake-resistant building connection comprising a first structural element and a second structural element that lie at a distance from each other, and where the first structural element comprises an outer side face facing the second structural element. The first structural element comprises at least one projecting element that projects from said outer side face of the first structural element and into a cavity in the second structural element, which cavity is wider, higher and deeper than the projecting element. The first structural element further comprises an elastic element that has an outer surface that extends around the projecting element, whereby a fill area is formed between the outer surface of the elastic element and the second structural element and further between the projecting element and the cavity, which fill area is filled with a filler.

In one or more embodiments of the earthquake-resistant building connection, the placed material in the fill area can be mortar or unreinforced concrete mix. Other suitable materials may of course also be used.

The elastic element may be embedded in the first structural element, but can also be fastened to the outer side face of the first structural element that faces the second structural element, if so desired.

In one or more embodiments of the earthquake building connection, the outer surface of the elastic element is essentially flush with said outer side face of the first structural element. Alternatively, the outer surface of the elastic element is slightly drawn in relative to the outer side face of the first structural element, or it projects out slightly relative to the outer side face of the first structural element.

The elastic element may be made of a rubber material, for example, Masticord®.

Further, between the first structural element and the second structural element there may be arranged a placement element such that the compound material in the fill area, on the first structural element, is only in contact with the elastic element. With the exception of the elastic element, the fill material is therefore at no point in contact with the outer side face of the first structural element that faces the second structural element.

In one or more embodiments of the earthquake building connection, the at least one projecting element is a telescopic inner tube that is arranged in an outer tube, the outer tube being fixedly arranged in the first structural element, for example, in that the outer tube is embedded in the first structural element. Alternatively, the projecting element is fixedly arranged in the first structural element, for example, in that it is embedded in the first structural element.

In one or more embodiments of the earthquake-resistant building connection, the first structural element can be a landing and the second structural element can be the wall in a stairwell. There is thus obtained an earthquake-resistant stairway in a building that has a simple construction and which makes it easy to erect a staircase in the stairwell.

There is also provided an earthquake-resistant staircase system comprising a building with a stairwell and at least one staircase unit comprising at least one landing, where the at least one landing is arranged in the stairwell and where the at least one landing is connected to the stairwell by a plurality of earthquake-resistant building connections as described above.

In one or more embodiments of the earthquake-resistant building connection, the at least one landing comprises at least four side faces, of which at least two of the side faces are opposing and face opposing walls in the stairwell, each of the two side faces being connected to the opposing walls in the stairwell by at least one earthquake-resistant connection. Between two landings there may be arranged a staircase that can be secured to one of the landings or both landings. A staircase can thus be movably supported on one or both landings.

In one or more embodiments of the earthquake-resistant building connection, the at least one landing comprises at least four side faces, of which three of the side faces face a wall in the stairwell, where each of the three side faces are connected to the stairwell by at least one earthquake-resistant building connection. Between two landings there may be arranged a staircase that can be fixedly secured to one of the landings or both landings. A staircase can thus be movably supported on one or both landings.

In one or more embodiments of the earthquake-resistant building connection, the staircase unit comprises a lower landing, an upper landing and a staircase section that extends between and is fixedly connected to the lower landing and the upper landing, where the lower landing and the upper landing are both connected to the stairwell by at least one earthquake-resistant connection. The lower landing and the upper landing can each comprise a side face facing in the opposite direction to each other and which each face two opposing walls in the stairwell, where the side faces are connected to the opposing walls in the stairwell by at least one earthquake-resistant connection.

In one or more embodiments of the earthquake-resistant building connection, between the stairwell or an adjacent landing and at least one side face of the at least one landing, which is not connected to a wall in the stairwell by the earthquake-resistant connection, there may be provided at least one elastic element. A landing and an adjacent landing can correspond to an upper landing and a staircase up to a half-pace and a lower landing on the staircase up to the next half-pace on the staircase unit.

In one or more embodiments of the earthquake-resistant building connection, there may further be arranged at least one elastic element between the stairwell and at least one side face of the at least one landing that is connected to the stairwell by the earthquake-resistant connection.

The elastic elements that may be arranged between a landing and a wall and/or an adjacent landing may be made from a rubber material, for example, Masticord®, i.e., the same material as the elastic elements in the earthquake-resistant building connections.

One or more non-limiting embodiments of the present invention will be described in detail below with reference to the attached figures, wherein:

FIG. 1 schematically illustrates an earthquake-resistant building connection according to one or more embodiments of the present invention.

FIG. 2 schematically illustrates the earthquake-resistant building connection as shown in FIG. 1.

FIGS. 3*a-b* are schematic side views through a stairwell with a plurality of staircase units with landings that are connected to the stairwell by earthquake-resistant building connections in the same way as shown in FIGS. 1-2.

Figure 1:
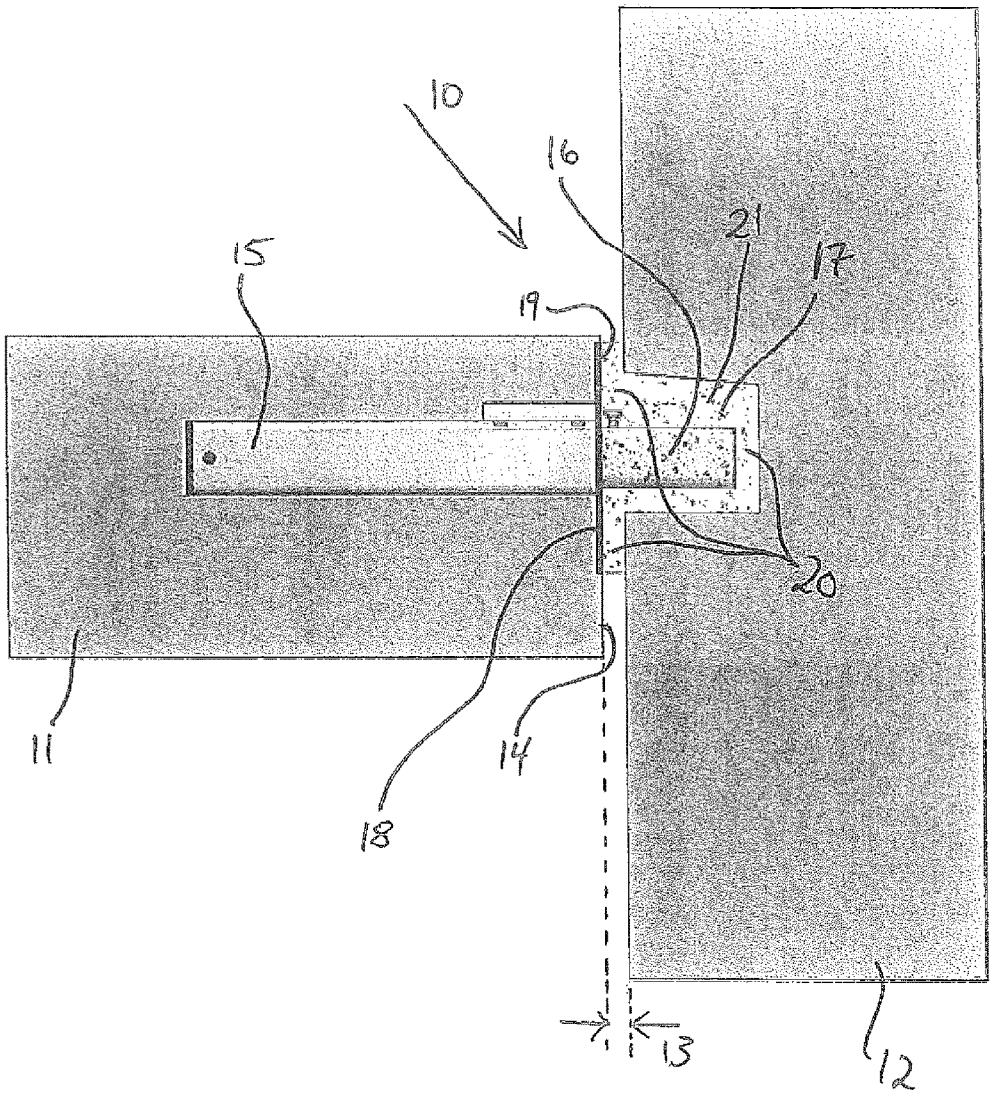
Figure 2:
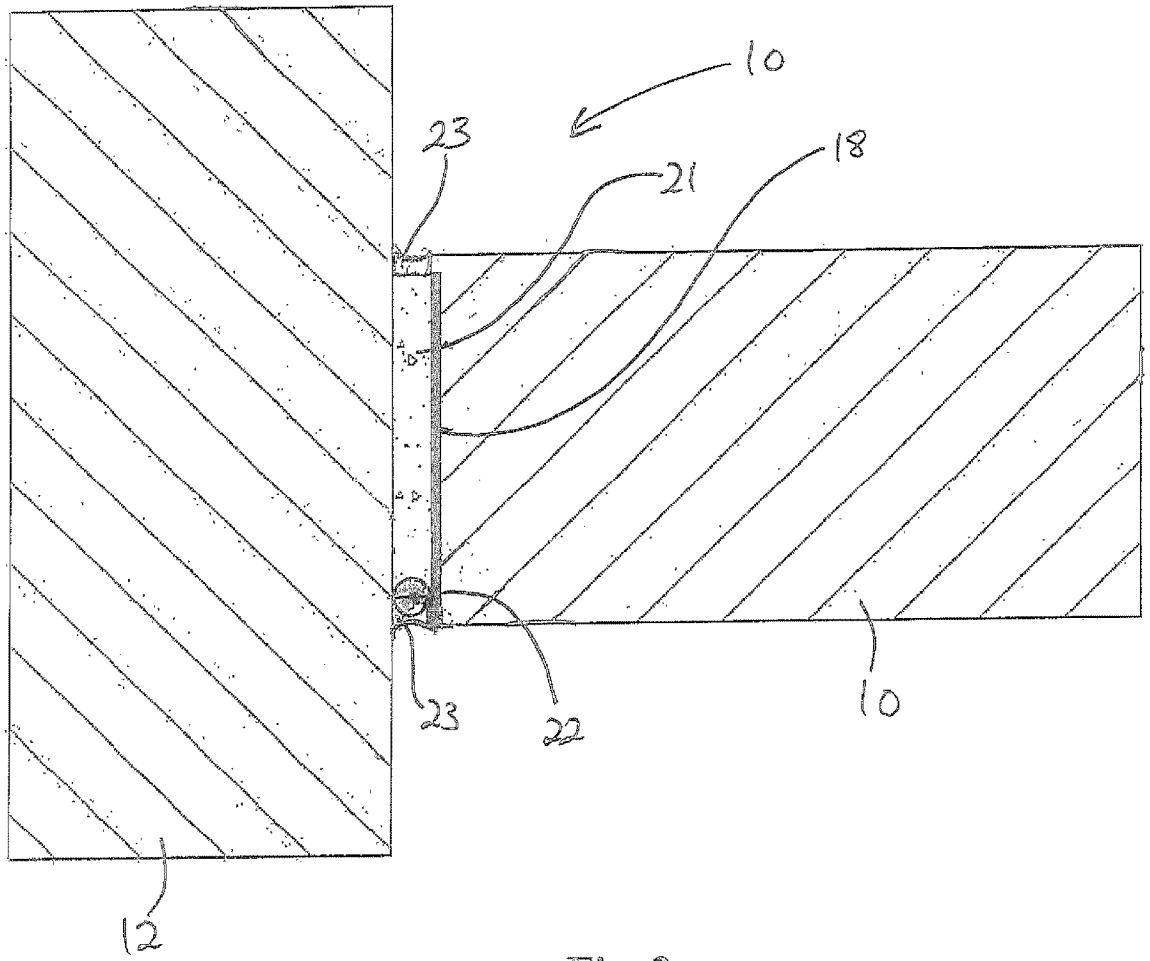
Figure 3B:
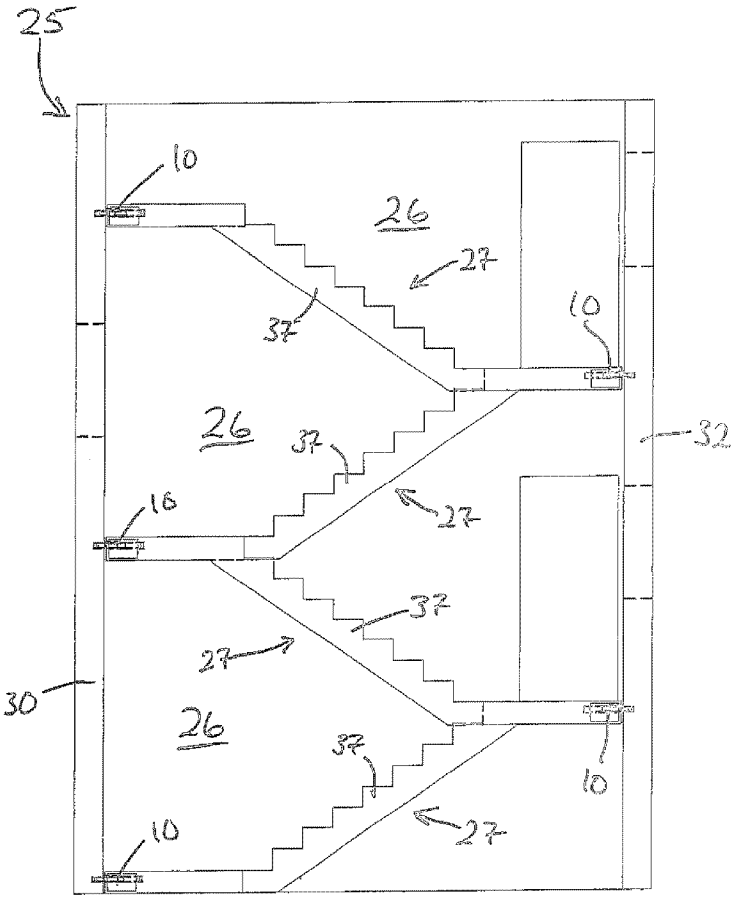
Figure 3A:
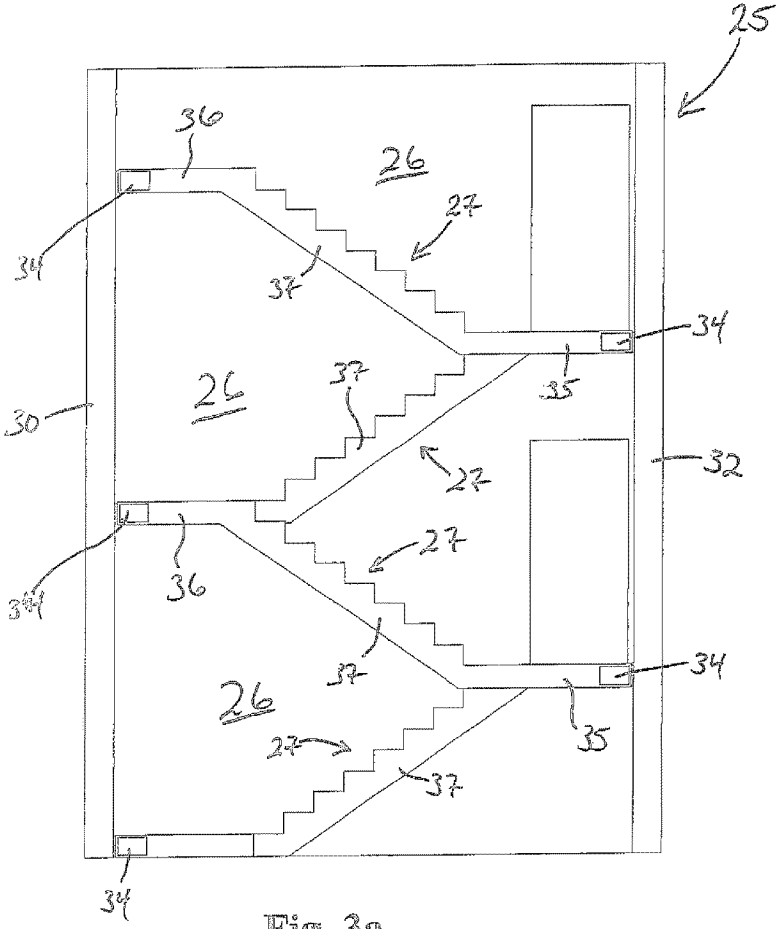

FIGS. 1-2 show an earthquake-resistant building connection 10 comprising a first structural element 11 and a second structural element 12. The first structural element 11 and the second structural element 12 can be structural elements of different types, but typically respectively a landing 28 and a wall 30, 31, 32, 33 in a stairwell 26 (see FIGS. 3-5). The first structural element 11 has an outer side face 14 that faces the second structural element and between the outer side face 14 of the first structural element and the second structural element 12 is provided a gap or distance 13. This means that the first structural element 11 and the second structural element 12 do not lie against each other and that it is thus possible to have a certain relative motion between the first structural element and the second structural element.

Figure 4:
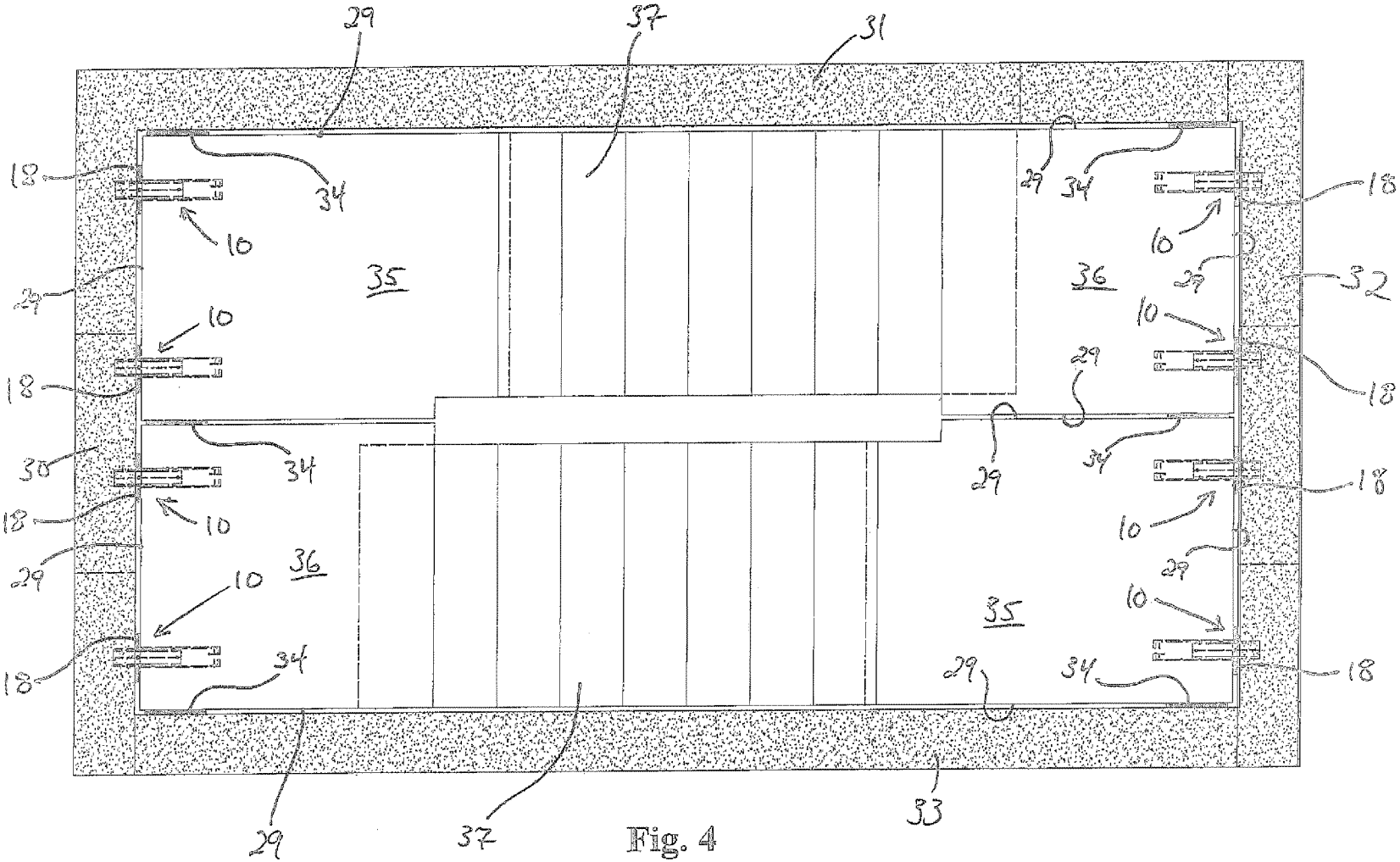
FIG. 4 is a schematic top view of the stairwell in FIG. 3 with landings that are connected to the stairwell by earthquake-resistant building connections as shown in FIGS. 1 and 2.
Figure 5:
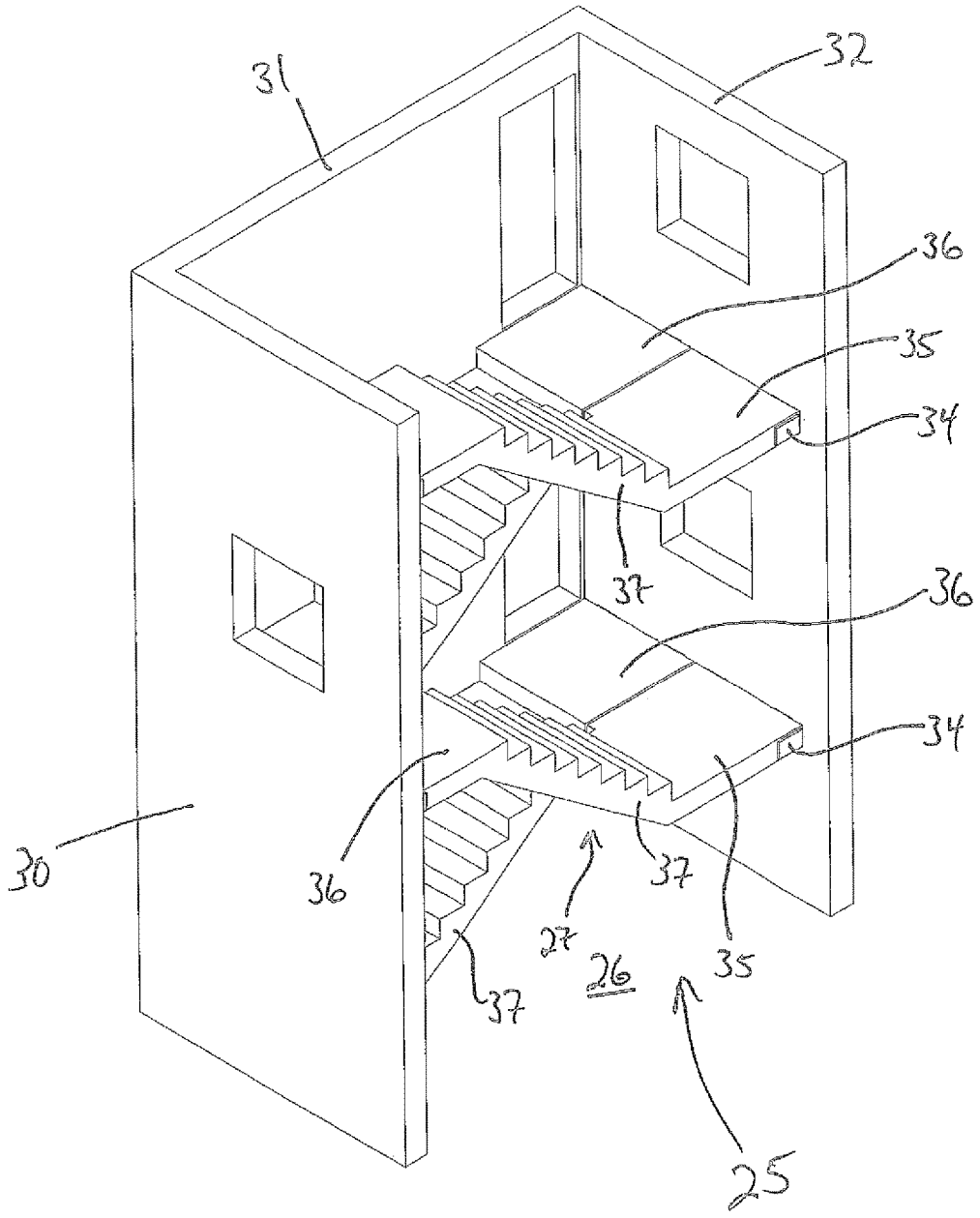
FIG. 5 is a schematic perspective view of the stairwell in FIGS. 3-4.

As shown in FIGS. 1, 3 and 4, the first structural element 11 comprises a projecting member 16 that projects from the outer side face 14 of the first structural element and into a cavity 17 in the second structural element 12 without the projecting element 16 being in direct contact with the second structural element 12. This is achieved in that the cavity 17 is wider, higher and deeper than the projecting element 16. The projecting element 16 may be an element that is embedded in the first structural element, but may be a part of an interconnecting system comprising an outer tube 15 that is embedded in the first structural element 11 and an inner tube that is telescopically arranged in the outer tube 15. The outer tube 15 has an opening that primarily lies flush with the outer side face 14 of the first structural element or slightly withdrawn relative to the outer side face 14. The inner tube is in its entirety accommodated in the outer tube and can be drawn out with the aid of a cord. Upon interconnecting the first structural element 11 and the second structural element 12, the first structural element 11 is first put in the correct position relative to the second structural element 12 such that the openings of the outer tubes lies vis-à-vis respective cavities 17 in the second structural element 12. The inner tubes 16 are then drawn out of their outer tubes and into respective cavities 17. The inner tubes 16 thus form projecting elements that project into their respective cavities 17.

The first structural element 11 is further provided with an elastic element 18 that may be embedded in the outer side face 14 of the first structural element that faces the second structural element 12 such that the surface 19 of the elastic element lies essentially flush with the outer side face 14 of the first structural element 11. The outer surface 19 of the elastic element need not necessarily lie flush with the outer side face 14 of the first structural element, but may project slightly from or be drawn slightly into the outer side face 14 of the first structural element, if so desired.

The elastic element may be made from a rubber material that can have a hardness of 72 Shore A. A typical example of a material that can be used is Masticord®, which is a commercially available material marketed by the US company JVI. The size, i.e., the area of the elastic element's outer surface 19 and the thickness of the elastic element 18, must be calculated in each individual case depending on the size of the loads each elastic element will have to absorb in the event of a possible earthquake and the size of the motions that have to be handled in connection with such an earthquake. These are calculations that a person of skill in the art, with the aid of suitable calculating tools, will be able to make and will not be described in more detail here.

The elastic element 18 is configured with an opening through which the projecting element 16 projects, and therefore extends at least partly around the projecting element 16 (i.e., the inner tube) and can lie in contact with the projecting element 16 or have a certain distance from the projecting element 16. Between the elastic element 18 and the second structural element 12, and further between the cavity 17 in the second structural element 12 and the projecting element 16 that projects into the cavity 17, there is formed a fill area 20 that is continuous, i.e., that none of the parts of the first structural element 11 are in contact with any parts of the second structural element 12. This fill area 20 is at least partly filled with filler 21. For example, the fill area 20 can be filled with mortar. Alternatively, other suitable materials can be used that are capable of filling the fill area 20. As shown in FIGS. 1 and 2, there is provided a placement element 22, for example, a neoprene strip, which extends around the edge of outer surface 19 of the elastic element 18 just below and on the sides of the elastic element 18. This makes it easy to carry out the filling of the fill area 20 and prevents filler, i.e., mortar, if that is the filler used, from lying between the first structural element 11 and the second structural element 12 beyond the outer surface 19 of the elastic element 18. In the earthquake-resistant building connection 10, the projecting element 16 thus rests on the filler 21 in the cavity 17 and the filler 21 rests against the outer surface 19 of the elastic element 18. In the event of an earthquake, forces and motions that are transferred between the first structural element 11 and the second structural element 12 will thus be absorbed in the elastic element 18. At the same time, the inner tubes 16 will be able to move in and out of their respective outer tubes 15. In the gap between the first structural element 11 and the second structural element 12 there can further be arranged an elastic joint or sealing strip 23 as shown in FIG. 2. The elastic joint or sealing strip 23 is positioned such that the space formed by the distance between the first structural element 11 and the second structural element 12, including earthquake-resistant building connections 10, is sealed off.

FIGS. 3*a-b* and 4-5 shows an earthquake-resistant staircase system 25 where a plurality of staircase units 27 is arranged in a stairwell 26. The staircase units 27, as shown in the figures, comprise two landings, a lower landing 35 and an upper landing 36, but could of course also comprise just one landing. Between the lower landing 35 and the upper landing 36 there is arranged a staircase 37. Each landing 35, 36 are connected to the stairwell by a plurality of earthquake-resistant building connections 10 as described above, for example, two earthquake-resistant building connections as show in the figures. A landing 35, 36 usually has three side faces 29, where one or more of the side faces 29 face one or more walls 30, 31, 32, 33 of the stairwell 26 and, in one or more embodiments in the figures, also an adjacent landing, but at a certain distance from the walls 30, 31, 32, 33 and the possible adjacent landing. In the same way as explained above, projecting elements 16, in one or more embodiments in the form of a telescopic inner tube 16 arranged in an outer tube 15 in the landings 35, 36, project from the landing 35, 36 into respective cavities 17 in the walls 30, 32 of the stairwell as shown in FIG. 4. As described above, the filler 21 is arranged in the fill area between the elastic elements 18 and the walls 30, 32 of the stairwell, including in the cavities 17, such that forces that are transferred between the landings 35, 36 and the stairwell 26, are essentially absorbed by the elastic elements 18 whilst the inner tubes 16 are able to move in and out of the outer tubes 15 in which they are arranged. In order further to absorb forces and motions that arise in connection with an earthquake, separate elastic elements 34 may also be provided between the landings and the walls 30, 31, 32, 33 in the stairwell 26 and/or an adjacent landing. The elastic elements 34 between the stairwell 26 walls 30, 31, 32, 33 and the landings 35, 36 are in addition to the elastic elements 18 in the earthquake-resistant building connections 10 that connect the stairway unit's 27 landings 35, 36 with one or more of the walls 30, 31, 32, 33. The elastic elements 34 can be made of the same material as the elastic elements 18 in the earthquake-resistant building connections 10, i.e., Masticord®, a commercially available material marketed and sold by JVI.

With earthquake-resistant building connections 10 between two structural elements, such as, for example, landing 28 walls in a stairwell 26 as described in detail above, there is provided an earthquake-resistant system that is considerably simpler in its construction and functioning than known systems for connecting structural elements in earthquake exposed areas.

The invention claimed is:

1. A building connection comprising a first structural element and a second structural element that lie at a distance from each other, and where the first structural element comprises an outer side face facing the second structural element, wherein the first structural element further comprises at least one projecting element that projects from said outer side face of the first structural element and into a cavity in the second structural element, wherein the projecting element has a width, a height, and a depth, and the cavity is wider, higher and deeper than the projecting element, wherein the first structural element further comprises an elastic element for absorbing forces and motions in the event of an earthquake, wherein the elastic element has an outer surface that extends around the projecting element and faces the second structural element, whereby a fill area is formed between the outer surface of the elastic element and the second structural element, and further between the projecting element and the cavity, and wherein the fill area is filled with a filler such that forces and motions that are transferred between the first structural element and the second structural element in the event of an earthquake are absorbed in the elastic element.

2. The building connection according to claim 1, wherein a placed material in the fill area is unreinforced concrete mix or mortar.

3. The building connection according to claim 1, wherein the outer surface of the elastic element lies essentially flush with said outer side face of the first structural element.

4. The building connection according to claim 1, wherein the elastic element is made of a rubber material.

5. An earthquake-resistant building connection according to claim 4, wherein the rubber material is a composite material comprising a rubber elastomer reinforced by a dispersion of randomly-oriented synthetic fabric fibers.

6. The building connection according to claim 1, wherein between the first structural element and the second structural element there is arranged a placement element such that a placed material in the fill area on the first structural element is only in contact with the elastic element.

7. The building connection according to claim 1, wherein the at least one projecting element is a telescopic inner tube that is arranged in an outer tube, and wherein the outer tube is fixedly arranged in the first structural element.

8. The building connection according to claim 1, wherein the first structural element is a landing and wherein the second structural element is a wall in a stairwell.

9. A staircase system comprising a stairwell and at least one staircase unit comprising at least one landing, wherein the at least one staircase unit and the at least one landing are arranged in the stairwell, and wherein the at least one landing is connected to the stairwell by a plurality of building connections according to claim 1.

10. The staircase system according to claim 9, wherein the at least one landing comprises at least four side faces, wherein at least two of the side faces are opposing and face opposing walls in the stairwell, and wherein each of the two opposing side faces are connected to the opposing walls in the stairwell by the at least one building connection.

11. The staircase system according to claim 9, wherein the at least one landing comprises at least four side faces, wherein three of the side faces face a wall in the stairwell, and wherein each of the three side faces are connected to the stairwell by the at least one building connection.

12. The staircase system according to claim 9, wherein the staircase unit comprises a lower landing and upper landing and a staircase section that extends between and is fixedly connected to the lower landing and the upper landing, and wherein the lower landing and the upper landing are both connected to the stairwell by the at least one building connection.

13. The staircase system according to claim 12, wherein the lower landing and the upper landing each comprise a side face facing in the opposite direction to one another and each facing respective opposing walls in the stairwell, wherein the side faces are connected to the opposing walls in the stairwell by the at least one building connection.

14. The staircase system according to claim 9, wherein between the stairwell and/or a landing of an adjacent staircase unit arranged in said stairwell and at least one side face of the at least one landing of said staircase unit, there is arranged at least one separate elastic element.

15. The staircase system according to claim 14, wherein the elastic element is made of a rubber material.

16. An earthquake-resistant staircase system according to claim 15, wherein the rubber material is a composite material comprising a rubber elastomer reinforced by a dispersion of randomly-oriented synthetic fabric fibers.

17. The staircase system according to claim 9, wherein there is arranged the at least one elastic element between the stairwell and at least one side face on the at least one landing that is connected to the stairwell by the building connection.

* * * * *